US012201219B2

(12) United States Patent
Willette

(10) Patent No.: US 12,201,219 B2
(45) Date of Patent: Jan. 21, 2025

(54) PACKABLE CHAIR

(71) Applicant: No Matter Products LLC, Sun Prairie, WI (US)

(72) Inventor: Shawn Dion Willette, Sun Prairie, WI (US)

(73) Assignee: No Matter Products LLC, Sun Prairie, WI (US)

( * ) Notice: Subject to any disclaimer, the term of this patent is extended or adjusted under 35 U.S.C. 154(b) by 119 days.

(21) Appl. No.: 18/186,701

(22) Filed: Mar. 20, 2023

(65) Prior Publication Data

US 2023/0292924 A1 Sep. 21, 2023

Related U.S. Application Data

(60) Provisional application No. 63/321,585, filed on Mar. 18, 2022.

(51) Int. Cl.
*A47C 1/14* (2006.01)
*A47C 3/16* (2006.01)
(Continued)

(52) U.S. Cl.
CPC ..... *A47C 1/146* (2013.01); *A47C 3/16* (2013.01); *A47C 4/06* (2013.01); *A47C 4/28* (2013.01);
(Continued)

(58) Field of Classification Search
CPC .. A47C 1/146; A47C 3/16; A47C 4/06; A47C 4/28; A47C 7/18; A47C 9/10; A47G 9/062
(Continued)

(56) References Cited

U.S. PATENT DOCUMENTS 1,209,808 A * 12/1916 Burgess ..... A47C 1/146 297/377
1,447,486 A * 3/1923 Schafer ..... A47C 1/146 297/377
(Continued)

FOREIGN PATENT DOCUMENTS

CA 3239831 A1 * 6/2023 ..... A47C 1/14
FR 2912624 A1 * 8/2008 ..... A47C 1/146
GB 2183467 A * 6/1987 ..... A47C 1/143

OTHER PUBLICATIONS

Big Agnes, "Skyline UL Chair," <https://www.bigagnes.com/collections/chairs/products/skyline-ul-chair> webpage available on or before Jan. 9, 2022.
(Continued)

*Primary Examiner* — Robert Canfield
(74) *Attorney, Agent, or Firm* — Michael Best & Friedrich LLP

(57) ABSTRACT

A chair includes a first fabric panel having a first end and a second end opposite the first end, a second fabric panel coupled to the first panel between the first end and the second end such that the second fabric panel divides the first fabric panel into a seat section between the second fabric panel and the first end and a rear section between the second fabric panel and the second end. Back support poles are received within sleeves extending along sides of the second fabric panel. The chair further includes cross support poles having ends coupled to the back support poles and opposite ends coupled to the second end of the second fabric panel. The cross support poles cross one another. The chair has an overall weight less than 12 ounces.

20 Claims, 18 Drawing Sheets

(51) Int. Cl.

| | |
|---|---|
| ***A47C 4/06*** | (2006.01) |
| ***A47C 4/28*** | (2006.01) |
| ***A47C 7/18*** | (2006.01) |
| ***A47C 9/10*** | (2006.01) |
| ***A47G 9/06*** | (2006.01) |

(52) U.S. Cl.
CPC ..... *A47C 7/18* (2013.01); *A47C 9/10* (2013.01); *A47G 9/062* (2013.01)

(58) Field of Classification Search
USPC ..... 297/16.1, 16.2, 17, 377, 452.16, 452.17; 5/417, 420
See application file for complete search history.

(56) References Cited

U.S. PATENT DOCUMENTS

| | | | | |
|---|---|---|---|---|
| 5,020,854 | A | 6/1991 | Powell | |
| 6,250,712 | B1 | 6/2001 | Livington et al. | |
| 9,173,493 | B1 * | 11/2015 | Fulton | A47C 7/72 |
| 9,271,576 | B2 | 3/2016 | Loney | |
| 12,070,427 | B2 * | 8/2024 | Nakajima | A61G 15/18 |
| 2004/0195891 | A1 | 10/2004 | Vaughan | |
| 2010/0045080 | A1 | 2/2010 | Haugan | |
| 2010/0171341 | A1 | 7/2010 | Loney | |
| 2011/0156466 | A1 * | 6/2011 | Linn | A47C 1/146 297/452.18 |

OTHER PUBLICATIONS

Big Agnes, "Skyline UL Stool," <https://www.bigagnes.com/collections/chairs/products/skyline-ul-stool> webpage available on or before Jan. 9, 2022.

Big Agnes, "Mica Basin Camp Chair," <https://www.bigagnes.com/collections/chairs/products/mica-basin-camp-chair> webpage available on or before Jan. 9, 2022.

Helinox, "Chair Zero," <https://helinox.com/products/chair-zero?variant=16664192286790> webpage available on or before Jan. 9, 2022.

Helinox, "Ground Chair," <https://helinox.com/products/ground-chair?variant=32676181246029> webpage available on or before Jan. 9, 2022.

REI, "REI Co-op Flexlite Air Chair," <https://www.rei.com/product/148036/rei-co-op-flexlite-air-chair> webpage available on or before Jan. 9, 2022.

REI, "REI Co-op Flexlite Camp Chair," <https://www.rei.com/product/164382/rei-co-op-flexlite-camp-chair> webpage available on or before Jan. 9, 2022.

Amazon, "Moon Lence Outdoor Ultralight Portable Folding Chairs with Carry Bag Heavy Duty 242lbs Capacity Camping Folding Chairs Beach Chairs," <https://www.amazon.com/dp/B00Y2A74L2?tag=outdoocom-20&linkCode=ogi&th=1> webpage available on or before Jan. 9, 2022.

Travel Chair, "Joey Chair," <https://travelchair.com/product/joey-chair-7789/> webpage available on or before Jan. 9, 2022.

Crazy Creek, "HEX 2.0 PowerLounger" <https://crazycreek.com/products/hex-2-0-powerlounger?variant=44499740033340> webpage available on or before Jan. 9, 2022.

Crazy Creek, "HEX 2.0 Original Chair" <https://crazycreek.com/products/hex-2-0-original-chair?variant=44499742359868> webpage available on or before Jan. 9, 2022.

Crazy Creek, "Original Chair" <https://crazycreek.com/collections/all-products/products/original-chair?variant=44773809324348> webpage available on or before Jan. 9, 2022.

* cited by examiner

PACKABLE CHAIR

CROSS-REFERENCE TO RELATED APPLICATIONS

This application claims priority to U.S. Provisional Patent Application No. 63/321,585, filed Mar. 18, 2023, the entire content of which is incorporated herein by reference.

BACKGROUND

The present disclosure relates to chairs, and more particularly to lightweight, packable chairs.

SUMMARY

With certain activities, such as camping, backpacking, mountaineering, hunting, military deployments, outdoor sporting/concert/festival events or the like, it is paramount to minimize the volume and weight of any packed items, thereby maximizing the use of limited packable space and to reduce energy expenditure due to load weight. Such efficiency demanding activities usually involve periods of down time, during which it may be desirable to sit and rest, observe scenery/event, etc. Accordingly, a need exists for a packable chair that is lighter in weight and more compact than conventional packable chairs.

The present disclosure provides, in one aspect, a chair including a first fabric panel having a first end and a second end opposite the first end, a second fabric panel coupled to the first panel between the first end and the second end such that the second fabric panel divides the first fabric panel into a seat section between the second fabric panel and the first end, the seat section configured to be sat upon by a user, and a rear section between the second fabric panel and the second end, a first back support pole received within a first sleeve extending along a first side of the second fabric panel, a second back support pole received within a second sleeve extending along a second side of the second fabric panel, a first cross support pole having a first end coupled to the second back support pole and a second end coupled to the second end of the second fabric panel, and a second cross support pole having a first end coupled to the first back support pole and a second end coupled to the second end of the second fabric panel, such that the first cross support pole and the second cross support pole cross one another. The chair has an overall weight less than 12 ounces.

The present disclosure provides, in another aspect, a chair including a first fabric panel having a first end and a second end opposite the first end, a second fabric panel coupled to the first panel between the first end and the second end such that the second fabric panel divides the first fabric panel into a seat section between the second fabric panel and the first end, the seat section configured to be sat upon by a user, and a rear section between the second fabric panel and the second end, a first back support pole received within a first sleeve extending along a first side of the second fabric panel, the first back support pole having first and second opposite ends, a second back support pole received within a second sleeve extending along a second side of the second fabric panel, the second back support pole having first and second opposite ends, a first cross support pole having a first end coupled to the second back support pole between the first and second ends of the second back support pole, and a second end coupled to the second end of the second fabric panel, and a second cross support pole having a first end coupled to the first back support pole between the first and second ends of the first back support pole, and a second end coupled to the second end of the second fabric panel, such that the first cross support pole and the second cross support pole cross one another.

Other aspects of the disclosure will become apparent by consideration of the detailed description and accompanying drawings.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
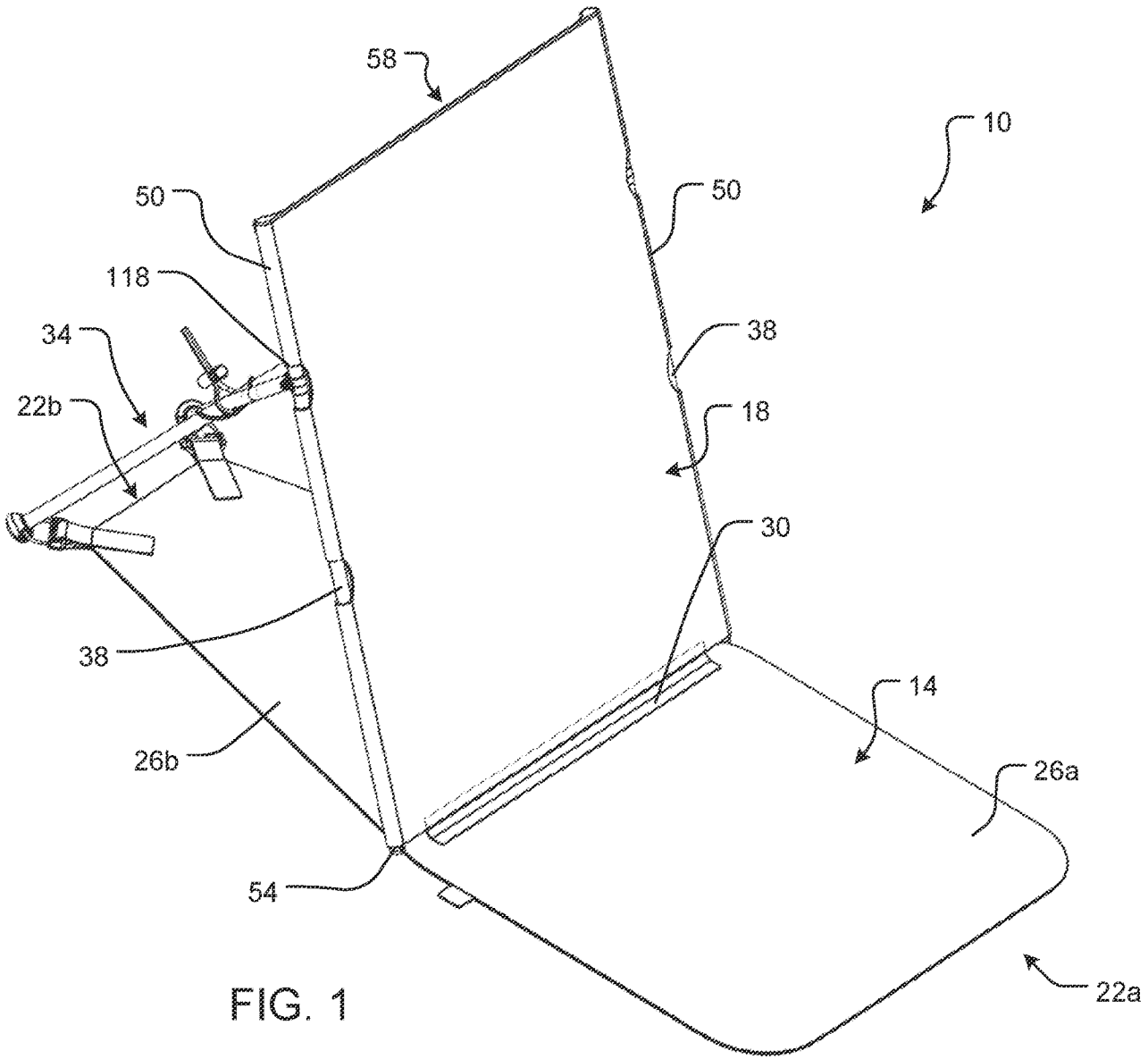
FIG. 1 is a front perspective view of a chair according to an embodiment of the present disclosure, with the chair illustrated in a deployed configuration.
Figure 5:
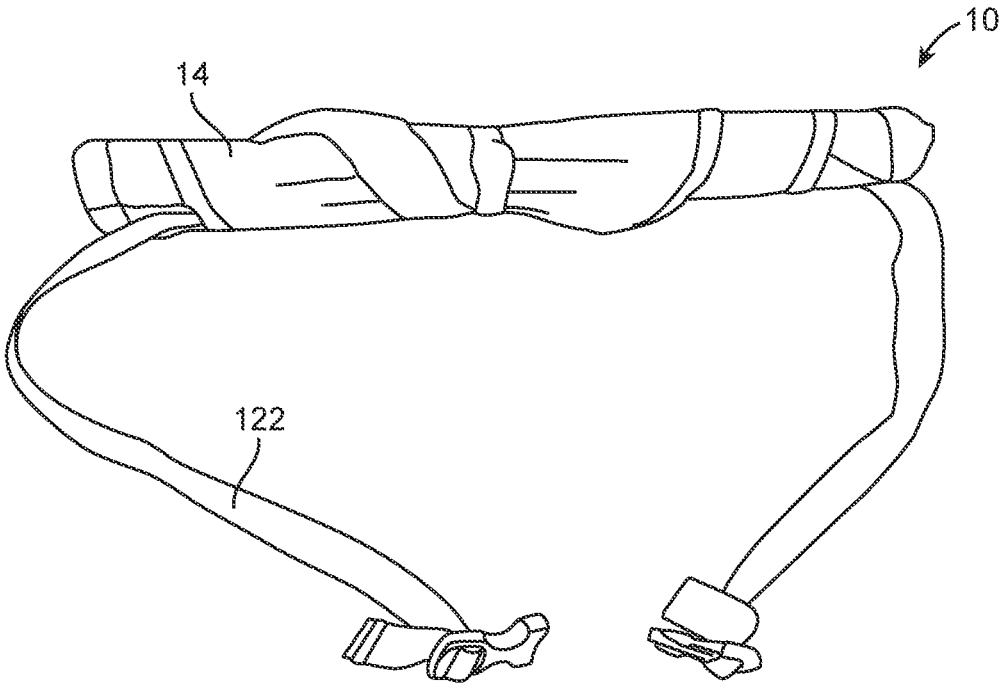
FIG. 5 illustrates the chair of FIG. 1 in a stored configuration.

FIG. 1 illustrates a chair 10 according to a first embodiment of the present disclosure. As described in detail below, the chair 10 is highly portable and lighter in weight than known portable chairs, making it particularly well suited for remote use during breaks in activities where it is important to minimize the volume and weight of any packed items to take advantage of limited packable space and to reduce energy expenditure. For example, the chair 10 may have an overall weight less than 12 ounces in some embodiments, less than 10 ounces in other embodiments, or less than 8 ounces in yet other embodiments. In the illustrated embodiment, the chair 10 has an overall weight between 5 and 8 ounces. In addition, the chair 10 has a deployed configuration (illustrated in FIGS. 1-2A), in which the chair 10 supports a sitting user, and a stored configuration (illustrated in FIG. 5), in which the chair 10 is broken down and rolled or folded into a compact, generally cylindrical shape for convenient packing and carrying.

With continued reference to FIG. 1, the illustrated chair 10 includes a first panel or base panel 14 and a second panel or support panel 18. Each of the panels 14, 18 comprises one or more layers of fabric. The fabric is preferably a strong, lightweight fabric such as nylon. A high tenacity nylon, such as nylon 6.6, may be particularly advantageous for its high tear and abrasion resistance and light weight. In other embodiments, however, other natural (e.g., cotton) or synthetic (e.g., polyester) fabrics, fabric blends, or coated (e.g., polyurethane) fabrics may be used. The fabric of the panels 14, 18 may be woven in a ripstop pattern for additional tear resistance.

The base panel 14 includes a front end 22*a* and a rear end 22*b* opposite the front end. The support panel 18 is coupled to the base panel 14 at an intermediate portion of the base panel 14 between the front end 22*a* and the rear end 22*b*. In some embodiments, the support panel 18 may be coupled to the base panel 14 approximately midway between the front end 22*a* and the rear end 22*b*. The support panel 18 thus divides the base panel 14 into a front or seat section 26*a*, configured to be sat upon by a user and including the front end 22*a* of the base panel 14, and a rear or cape section 26*b*, including the rear end 22*b* of the base panel 14.

The support panel 18 may be coupled to the base panel 14 via one or more rows of stitching. In the illustrated embodiment, a reinforcing strip 30 is coupled (e.g., stitched) to the support panel 18 and the base panel 14 at the interface between the support panel 18 and the base panel 14 to strengthen the connection between the panels 14, 18. The reinforcing strip 30 is also preferably made of one or more layers of fabric, such as nylon webbing. In other embodiments, the support panel 18 may be coupled to the base panel 14 using a fabric adhesive, heat setting polymer, or the like.

In some embodiments, the base panel 14 includes a water-resistant coating on the top, mid, and/or bottom sides of the base panel 14. The water-resistant coating may be made of PVC, polyurethane, or any other suitably flexible, water-resistant coating able to be adhered to the fabric material of the base panel 14. The water-resistant coating advantageously inhibits water from soaking through the base panel 14 if the chair 10 is placed on a wet surface, such as wet ground. In some embodiments, the support panel 18 may also include a water-resistant coating.

Figure 2A:
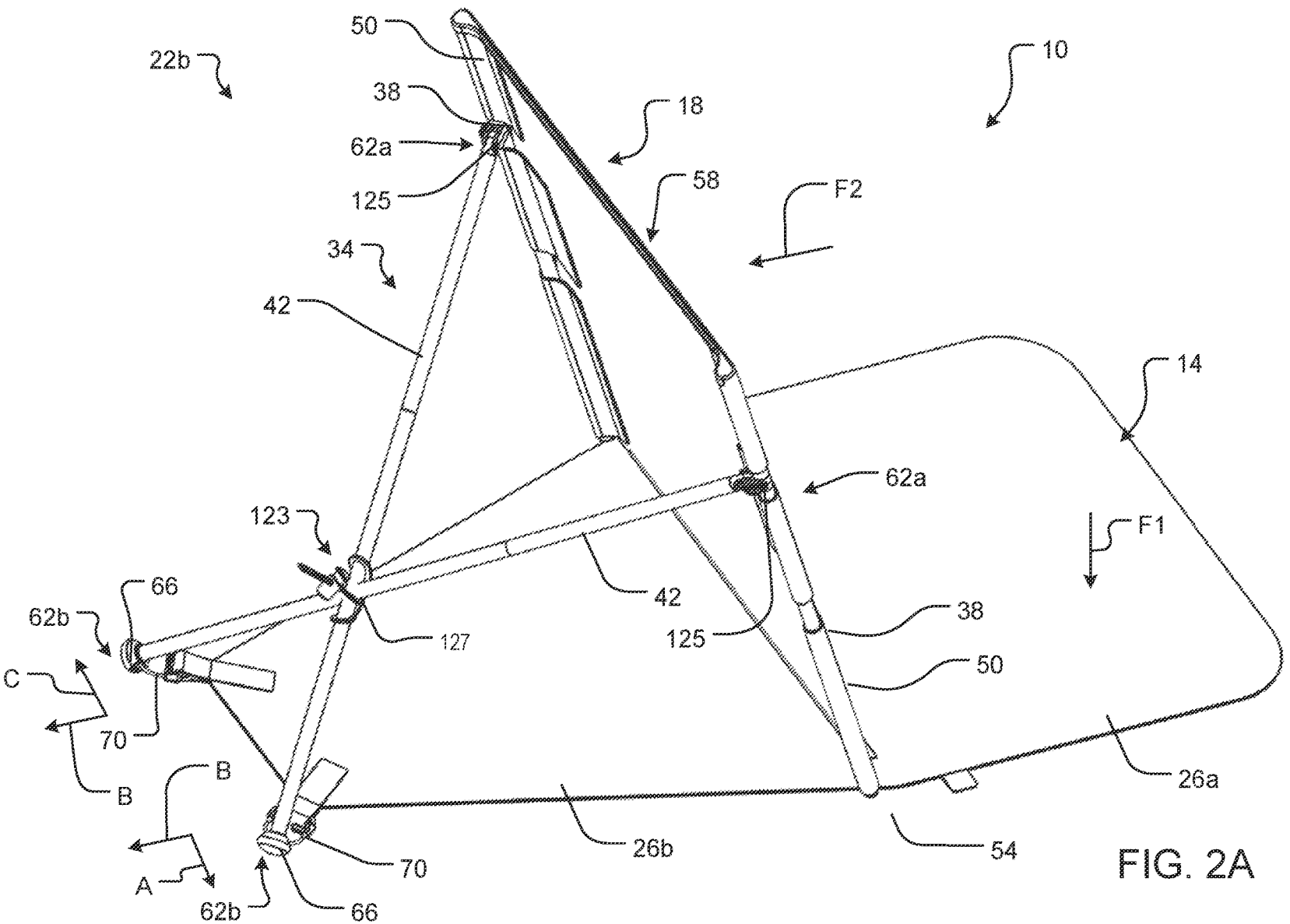
FIG. 2A is a rear perspective view of the chair of FIG. 1, illustrating an assembly of poles of the chair.
Figure 6:
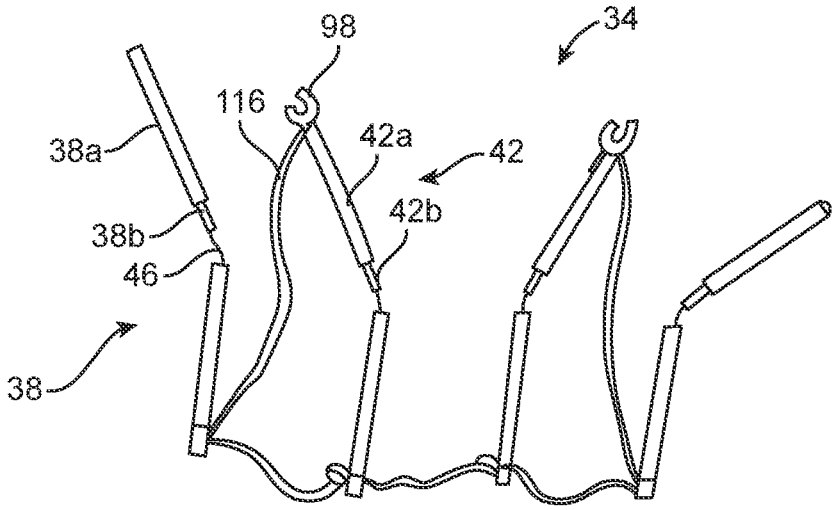
FIG. 6 is a perspective view illustrating an embodiment of a pole assembly, which may be incorporated into the chairs of FIGS. 1, 7, and 23, and illustrated in a disassembled configuration.

With reference to FIG. 2A, the chair 10 further includes a pole assembly 34 configured to provide structural reinforcement and shape to the chair 10. The illustrated pole assembly 34 includes a pair of first or back support poles 38 and a pair of second or cross support poles 42. As shown in FIG. 6, in some embodiments, the back support poles 38 and the cross support poles 42 may each include a plurality of telescoping and/or modular sections 38*a*, 42*a* to facilitate disassembly and compact storage of the pole assembly 34. The telescoping sections may be interconnected by tubular pole inserts 38*b*, 42*b* and/or an integrated elastic cord 46 to retain the sections together and to facilitate assembly of the telescoping sections by biasing the interconnected sections towards one another. The poles 38, 42 are preferably made of a strong and lightweight material, such as fiber-reinforced composites (e.g., carbon fiber), aluminum, or titanium. In some embodiments, the pole sections 38*a*, 42*a* may be made of a first material (e.g., a fiber-reinforced composite) and the pole inserts 38*b*, 42*b* may be made of a second material (e.g., aluminum or titanium) that is different than the first material. The pole inserts 38*b*, 42*b* may have one end fixed within a corresponding pole section 38*a*, 42*a* (e.g., by adhesive, a press fit, mechanical fasteners, or the like) and an opposite end that is slidable in and out of an end of an adjacent pole section 38*a*, 42*a* to allow for disassembly of the pole assembly 34.

The back support poles 38 are received in respective sleeves 50 extending along the sides of the support panel 18. In the illustrated embodiment, the back support poles 38 are inserted through openings 54 in the sleeves 50 adjacent the base panel 14, until ends of the back support poles 38 contact the closed ends of the sleeves 50 at a top end 58 of the support panel 18. In this way, the back support poles 38 give structure to the support panel 18 and may also produce cross tension on the support panel 18.

With continued reference to FIG. 2A, the cross support poles 42 each include a first end 62*a* and a second end 62*b* opposite the first end 62*a*. In the illustrated embodiment, the first end 62*a* is a pole-engaging end configured to engage a respective one of the back support poles 38, between a first end and a second end of the back support pole 38. The cross support poles 42 second end 62*b* is a ground-engaging end configured to engage the ground (or another surface) when the chair 10 is positioned thereon in the deployed position. As discussed in greater detail below, the cross support poles 42 are arranged in a crossing or X-shape, to provide opposing tension on the cape section 26*b* and support panel 18.

In the illustrated embodiment, the cross support poles 42 of the pole assembly 34 are joined together by a cross pole connector 123. The illustrated cross pole connector 123 includes a guide plate 127 with two spaced apertures through which one of the cross support poles 42 extends. The other of the cross support poles 42 extends between the first cross support pole 42 and the guide plate 127 between the two apertures. The cross pole connector 123 thus keeps the two cross support poles 42 from separating from one another, while still allowing the cross support poles 42 to pivot relative to one another.

Figure 2C:
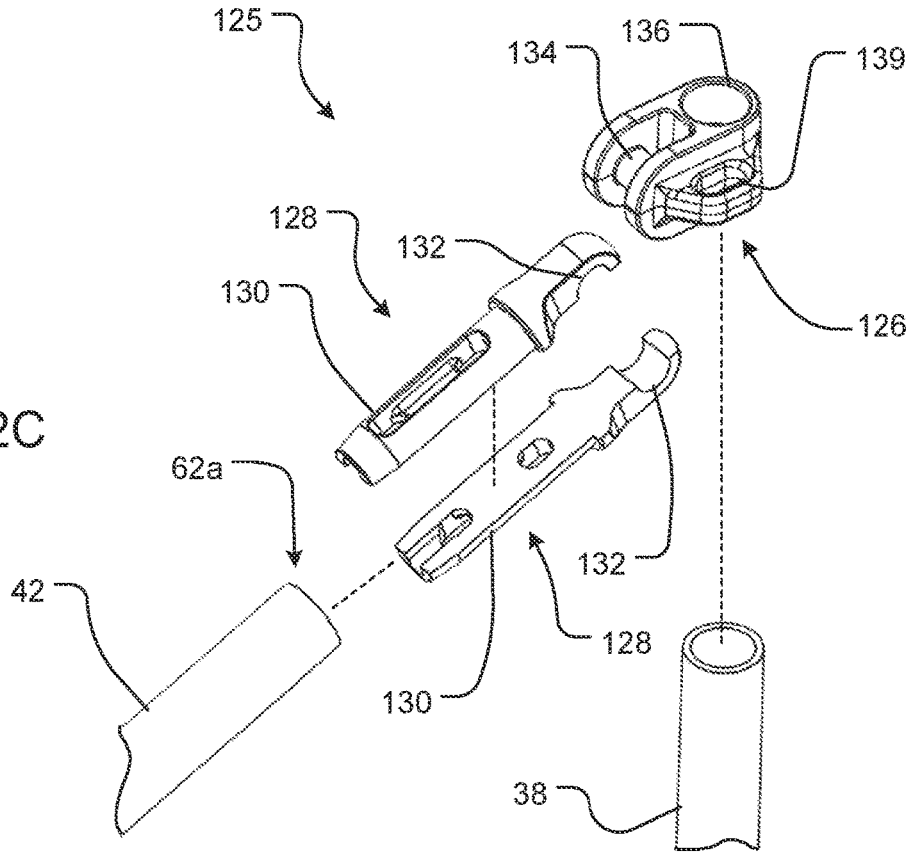
FIG. 2C is an exploded perspective view illustrating a pole connector according to an embodiment, which may be incorporated into the chairs of FIGS. 1, 7, and 23.
Figure 2B:
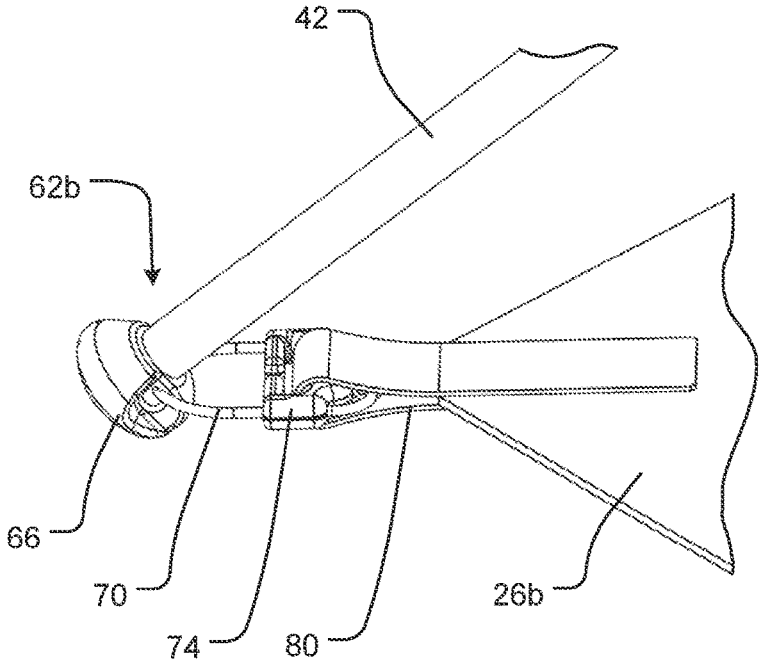
FIG. 2B is a perspective view illustrating a lower pole retainer according to an embodiment, which may be incorporated into the chairs of FIGS. 1, 7, and 23.

With reference to FIG. 2B, in the illustrated embodiment, the second end 62*b* of each cross support pole 42 includes a foot 66 (e.g., made of plastic or rubber) and a tether 70 extending through the foot 66. The tether 70 is coupled to a bracket 74, which in turn is coupled to a loop 80 affixed to the corner of the cape section 26*b*. The loop 80 may be stitched, welded, or otherwise secured to the cape section 26*b* in any suitable manner. The loop 80 and bracket 74 act as a lower pole retainer that couples the second end 62*b* of the cross support pole 42 to the corner of the cape section 26*b*. In some embodiments, the second end 62*b* of the support pole 42 may be permanently coupled to the cape section 26*b* after assembly of the chair 10; in other embodiments, the second end 62*b* of the support pole 42 may be detachable from the cape section 26*b*.

Figure 3:
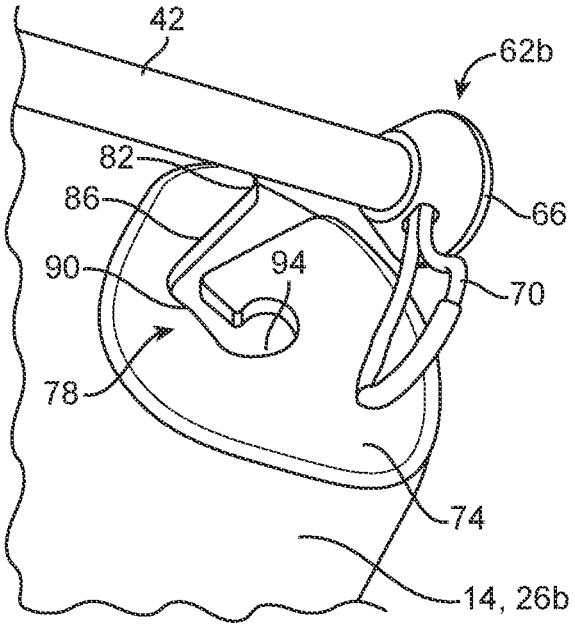
FIG. 3 is an enlarged perspective view illustrating a lower pole retainer according to another embodiment, which may be incorporated into the chairs of FIGS. 1, 7, and 23.

Referring to FIG. 3, in another embodiment, the cape section 26*b* may include a bracket 74 at each of its rear corners. The brackets 74 may be fixed directly to the material of the base panel 14 in any suitable manner or attached using a secondary piece of sewn/adhered fabric reinforcement (e.g., nylon webbing loop). For example, each bracket 74 may include two halves, with the base panel 14 sandwiched between the two halves and adhered using an adhesive (e.g., epoxy), welding, mechanical fastening (e.g., teeth on the bracket penetrating the base panel 14), or a combination thereof.

Each bracket 74 includes a lower pole retainer 78, which, in the illustrated embodiment, includes a labyrinth channel. The labyrinth channel includes a mouth 82, a first channel portion 86 extending from the mouth 82, a second channel portion 90 extending from the first channel portion 86, and a seat 94 formed at an end of the second channel portion 90 opposite the first channel portion 86. The lower pole retainer 78 is configured to couple the second end 62*b* of the cross support pole 42 to the bracket 74 by receiving the tether 70 in the seat 94 of the labyrinth channel. The first channel portion 86 tapers from a greater width at the mouth 82 to a narrower width at the transition to the second channel portion 90, and the second channel portion 90 extends from the end of the first channel portion 86 at an oblique angle. This geometry of the labyrinth channel allows the tether to be easily positioned in the seat 94 but difficult to inadvertently dislodge from the seat 94 without a specific action by the user to feed the tether 70 back out of the labyrinth channel.

Referring to FIG. 2C, the first end 62*a* of each cross support pole 42 is coupled to a corresponding one of the back support poles 38 by a pole connector 125. The pole connectors 125 on the cross support poles 42 attach to the first poles 38 at longitudinal gaps 118 formed in the sleeves 50, through which portions of the back support poles 38 are exposed (FIG. 1). In the illustrated embodiment, the gaps 118 in the sleeves 50 are located closer to the top end 58 of the support panel 18 than the interface between the support panel 18 and the base panel 14.

Figure 2D:
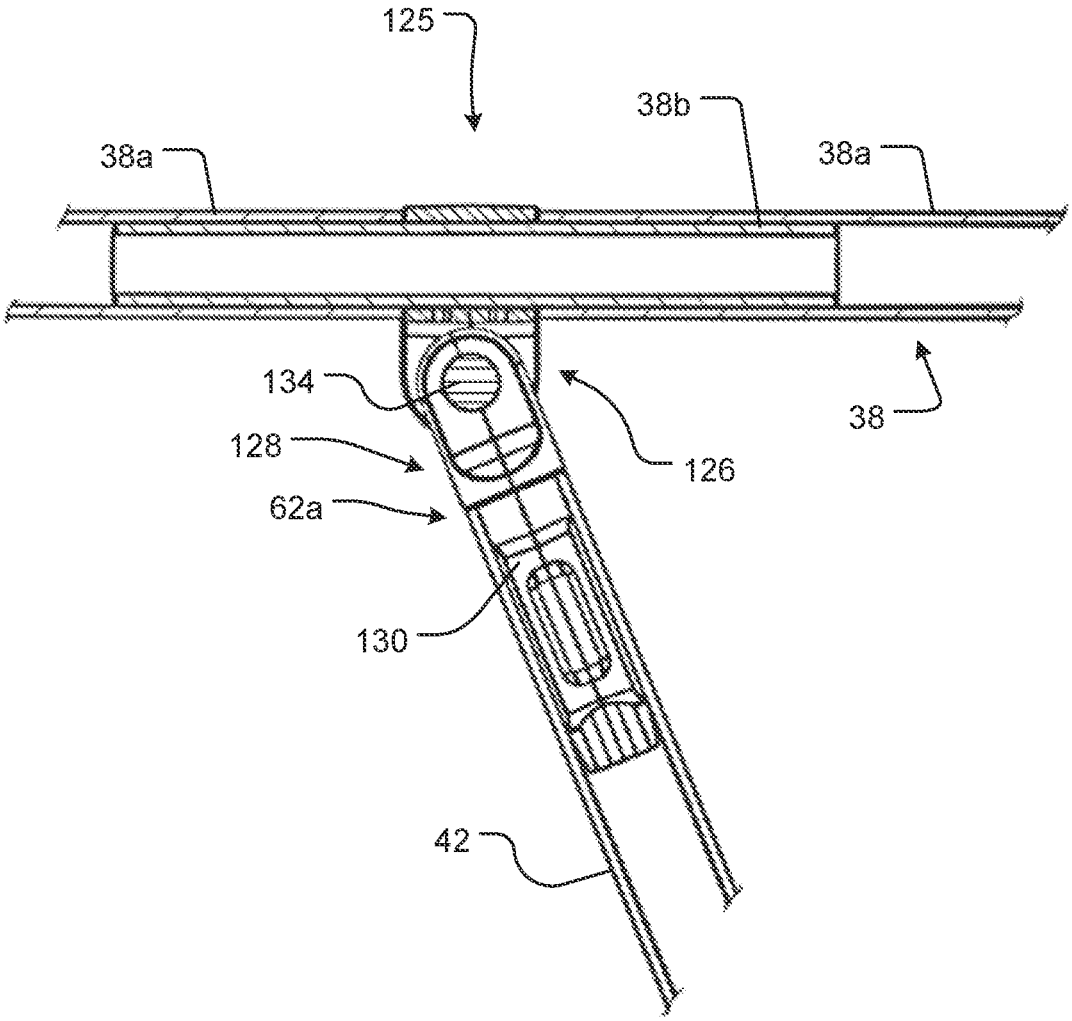
FIG. 2D is a cross-sectional view of the pole connector of FIG. 2C.

Referring to FIGS. 2C-2D, the illustrated pole connector 125 includes a clevis 126 and a pair of pivot arms 128. Each of the pivot arms 128 has a reduced diameter shank portion 130 sized to be insertable into the first end 62*a* of the cross support pole 42 and a semi-circular recess 132 adjacent an end opposite the shank portion 130. The illustrated clevis 126 includes an ear 139 with an aperture able to receive a guide line (not shown), thereby allowing the chair 10 to be staked down using a tent anchor or the like for additional support (e.g., to inhibit the chair 10 from moving in windy conditions).

During assembly, the semi-circular recesses 132 of the pivot arms 128 are aligned with a pin 134 of the clevis 126, and then brought together to capture the pin 134 between the two semi-circular recesses 132. In some embodiments, the pivot arms 128 may be coupled together via a snap fit or any other suitable manner. Once the pivot arms 128 are brought together, the shank portions 130 are inserted into the first end 62*a* of the cross support pole 42. Finally, the clevis 126 is pressed on to the back support pole 38 such that the back support pole 38 is received within a bore 136 in the clevis 126. In the illustrated embodiment, the clevis 126 is coupled to the pole insert 38*b* of the back support pole 38 and disposed between two adjacent pole sections 38*a* (FIG. 2D). However, the clevis 126 may be directly coupled to one of the pole sections 38*a* in other embodiments.

The pole connector 125 thus pivotally couples the first end 62*a* of each cross support pole 42 to a corresponding one of the back support poles 38. In some embodiments, the clevis 126 may be pivotable about the back support pole 38 to allow the cross support pole 42 to pivot relative to the back support pole 38 about two separate axes.

Figure 4:
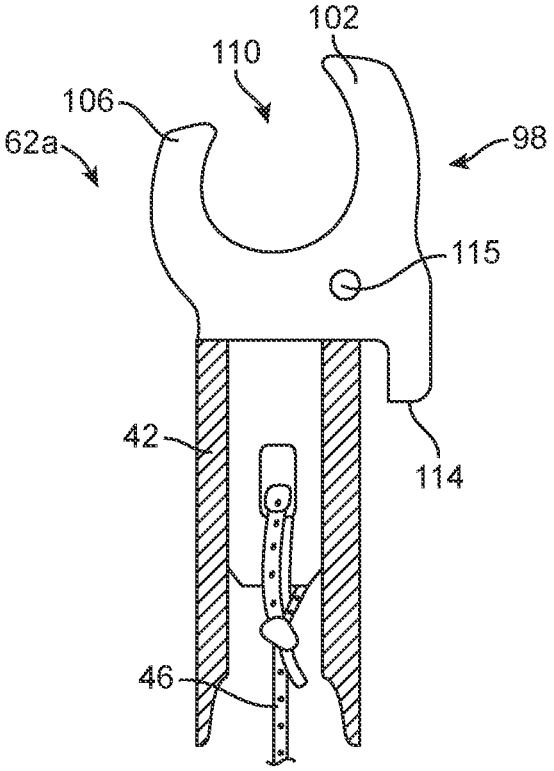
FIG. 4 is a cross-sectional view illustrating a pole connector according to another embodiment, which may be incorporated into the chairs of FIGS. 1, 7, and 23.

With reference to FIG. 4, in another embodiment, the first end 62*a* of each cross support pole 42 includes a pole connector 98 having a first curved arm 102 and a second curved arm 106 collectively defining a generally C-shaped recess 110. The C-shaped recess 110 is sized and shaped to receive one of the back support poles 38 therein to couple the cross support pole 42 to the back support pole 38. The arms 102, 106 are preferably made of a resilient yet ductile material, such as a durable plastic material, to flex slightly outward when the back support pole 38 is inserted into the recess 110. The arms 102, 106 then exert a restoring force on the back support pole 38 to grip and retain the back support pole 38 within the recess 110. In some embodiments, the pole connector 98 may further include a third arm 114, extending in a direction generally opposite the first and second arms 102, 106. The third arm 114 is a hook-type feature added to some embodiments to allow an elastic tether or shock-cord loop to be held captive by the pole connector 98, thereby acting as a secondary retaining feature to maintain the back support pole 38 seated within recess 110. The elastic tether or shock-cord loop may originate/terminate from one or more locations, including but not limited to the cross support pole 42, the back support pole 38, the support panel 18, and/or the pole connector 98, itself.

In some embodiments, the pole connector 98 may be removable from and also slidable along the back support pole 38. In such embodiments, a cable (not shown) may extend from each pole connector 98 to the second end 65*b* of each of the back support poles 38. In one embodiment, the cables may be coupled to the pole connectors 98 by passing through a hole 115 (FIG. 4) and terminating the end of the cable (e.g., a knot tie-off, a crimped-on barrel stop, or knotted back on itself). The cables therefore interconnect the first ends 62*a* of the cross support poles 42 with the second ends 76*b* of the back support poles 38. The cables may prevent the pole connectors 98 from sliding axially along the back support poles 38 toward the first ends 65*a*. In some embodiments, the cables are thin, lightweight, and flexible, containing high strength braided metal or polymer tension members, and may be, for example, stainless steel, Kevlar® fiber, or nylon braided cables. Additionally, the cables may be coated with one or more protective polymer layers for improved durability and corrosion resistance.

Referring to FIG. 2A, when the chair 10 is in its deployed position, a user may sit upon the seat section 26*a* and lean back against the support panel 18, which defines a back support of the chair 10. The user's weight acts on the seat section 26*a* in the direction of arrow F1, and on the support panel 18 in the direction of arrow F2. The poles 38, 42 transfer the force F2 to the cape section 26*b*, producing multi-axis tension on the cape section 26*b*. More specifically, the X-shape of the cross support poles 42 tensions the cape section 26*b* in a rearward direction (arrow B) and lateral directions (arrows A and C).

When finished sitting on the chair 10, the user may collapse the chair 10 by pivoting the ends 62*a*, 62*b* of the cross support poles 42 toward one another, about the cross pole connector 123. The second ends 62*a*, 62*b* of the cross support poles 42 may also be pivoted toward the back support poles 38 about the pins 134 of the pole connectors 125. The fabric of the panels 14, 18 can be rolled and/or folded up between the poles 38, 42, such that the chair 10 is collapsible into an elongated, slender package size (e.g., FIG. 3). The chair 10 may then be inserted into a carrying case, stuff-sack, or the like for transport.

In some embodiments, the chair 10 may be disassembled by detaching the cross support poles 42 from the lower pole retainers 78 (e.g., FIG. 3) and from the back support poles 38, and then removing the back support poles 38 from the sleeves 50. The telescoping sections of the poles 38, 42 may then be separated. With the poles 38, 42 removed, the support panel 18 can be laid flat against the base panel 14. The user may then place the poles 38, 42 on top of the panels 14, 18 and roll the panels 14, 18 around the poles 38, 42 to place the chair 10 in its stored configuration. Alternatively, some embodiments may include an open or zippered pocket 71 (see e.g., FIG. 24) on the rear face of panel 18 to protect, store, and retain the collapsed poles 38, 42 prior to rolling up the aforementioned assembly into the stored configuration. In some embodiments, the chair 10 may include a carrying strap 122 (FIG. 5), allowing the chair 10 to be carried by or attached to the user in a hands-free manner (e.g., by coupling the strap 122 around the user's waist, shoulder, pack, or the like).

Figure 7:
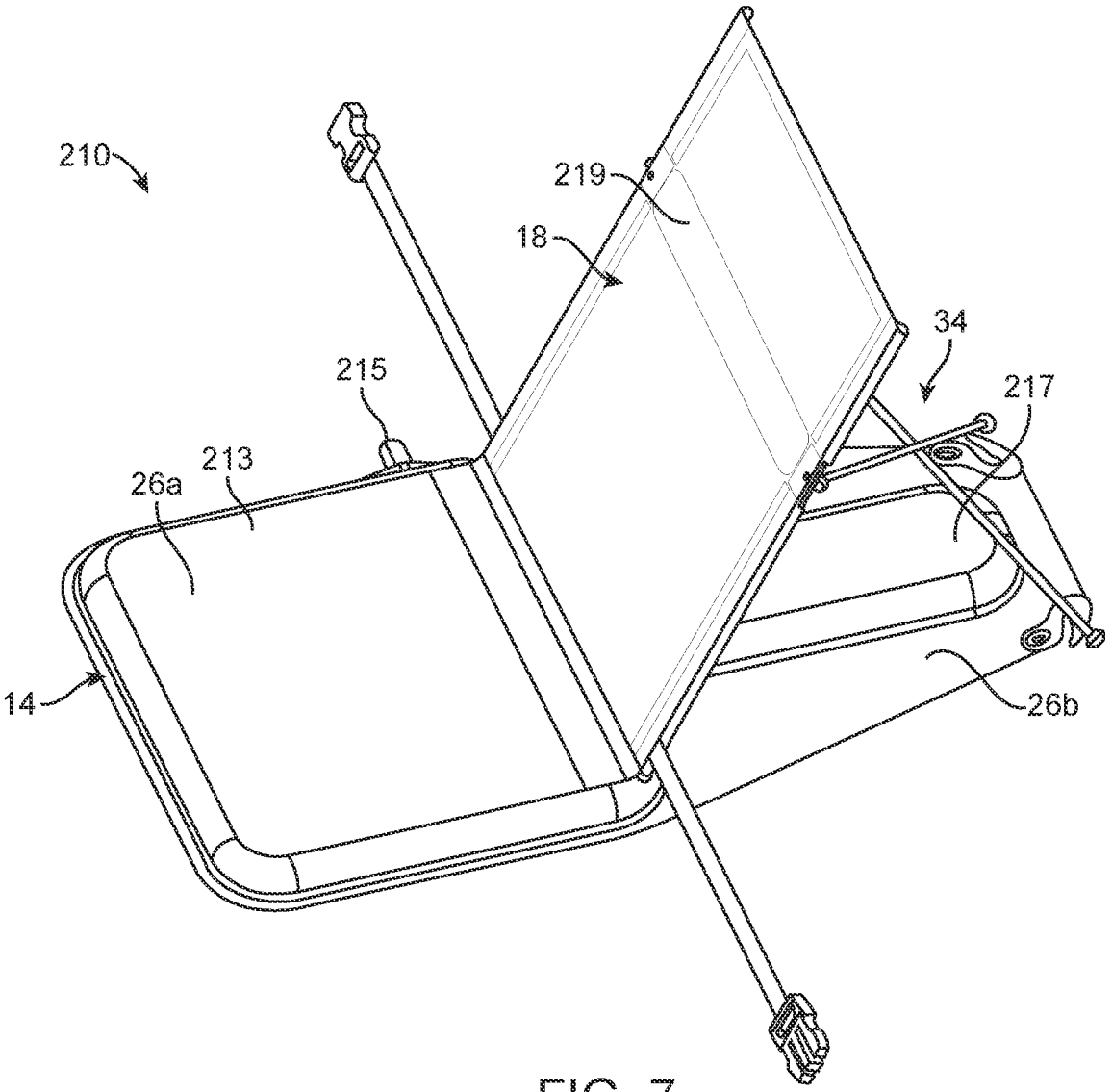
FIG. 7 is a perspective view of a chair according to another embodiment of the present disclosure.

FIG. 7 is a perspective view of a chair 210 according to another embodiment of the present disclosure. The chair 210 is similar to the chair 10 described above, and features and/or elements of the chair 210 may be incorporated into the chair 10, and vice versa. In addition, the following description focuses only on differences between the chair 210 and the chair 10, and features of the chair 210 corresponding with features of the chair 10 are given identical reference numbers.

The illustrated chair 210 includes a cushion 213 located within the seat section 26*a* of the base panel 14, to increase user comfort. The cushion 213 is preferably made of an open-cell foam material able to be filled with air. When the chair 210 is in its stored configuration, the open cell foam material of the cushion 213 is compressed, expelling air from the cells, and allowing the cushion 213 to be stored in a more compact size. When the chair 210 is unrolled and put in the deployed position, shown in FIG. 7, the foam expands, drawing air into the cells through a valve 215. The valve 215 may be opened and closed to selectively allow and prevent air from flowing into and out of the cushion 213.

With continued reference to FIG. 7, the illustrated chair 210 further includes a spine 217 extending along the cape section 26*b* of the base panel 14. The spine 217 may be formed as an extension of the cushion 213, to inflate and deflate with the cushion 213. The spine 217 provides additional support and structure to the cape section 26*b*, which may facilitate deployment and enhance structural rigidity of the chair 210 (e.g., including proper placement and connection of the pole assembly 34). In some embodiments, the chair 210 may also include a rib 219 extending laterally across the support panel 18. The rib 219 may also be inflatable like the spine 217, or the rib 219 may be formed from one or more additional layers of fabric material, flexible plastic material, or the like. The rib 219 is configured to provide additional support and structure to the support panel 14, which may further facilitate deployment of the chair.

The cushion 213 and spine 217 may be positioned and secured within the base panel 14 in various ways. In some embodiments, the cushion 213 and spine 217 are welded between two layers of the base panel 14. Alternative embodiments may involve the base panel 14 including a pocket formed between two layers or an exterior attachment feature, thereby allowing the cushion 213 and/or the spine 217 to be removably received within the pocket or selectively coupled to support panel 14. In such embodiments, the cushion 213 and spine 217 may be used to provide enhanced user comfort and facilitate deployment of the chair 210, but may be removed when it is desired to further minimize the size and weight of the chair 210. The rib 219 may similarly be welded between two layers of the support panel 18, received in a pocket of the support panel 18, etc.

Figure 8:
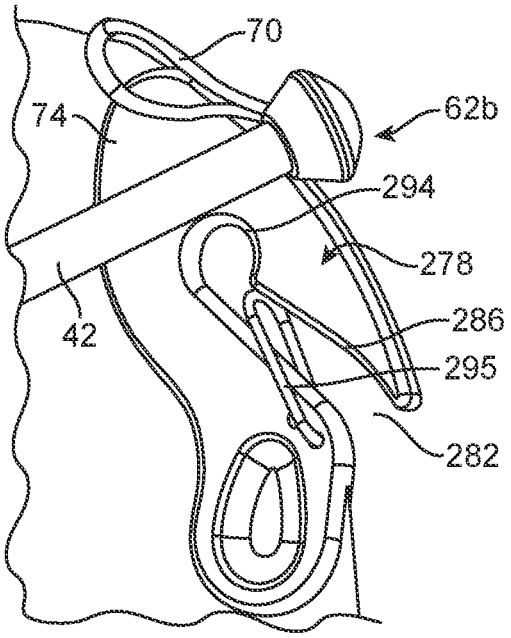
FIG. 8 is an enlarged perspective view illustrating a lower pole retainer according to another embodiment, which may be incorporated into the chairs of FIGS. 1, 7, and 23.

FIG. 8 illustrates a lower pole retainer 278 according to another embodiment, which may be incorporated into the chairs 10, 210 and any of the other chairs described herein. Like the lower pole retainer 78 described above, the lower pole retainer 278 is configured to receive the tether 70 on the second end 62*b* of one of the cross support poles 42. The lower pole retainer 278 includes a mouth 282, a channel 286 extending from the mouth 282, and a seat 294 formed at an end of the channel 286 opposite the mouth 282. A spring clip 295 is pivotally coupled to the bracket 74 and extends across the channel 286. The clip 295 is angled in a direction from the mouth 282 toward the seat 294 to allow the tether 70 to push the clip 295 out of the way (resiliently deforming the clip), when inserting the tether 70 into the lower pole retainer 278. The clip 295 then moves back across the channel 286 to prevent the tether 70 from being inadvertently pulled out of the lower pole retainer 278.

Figure 9:
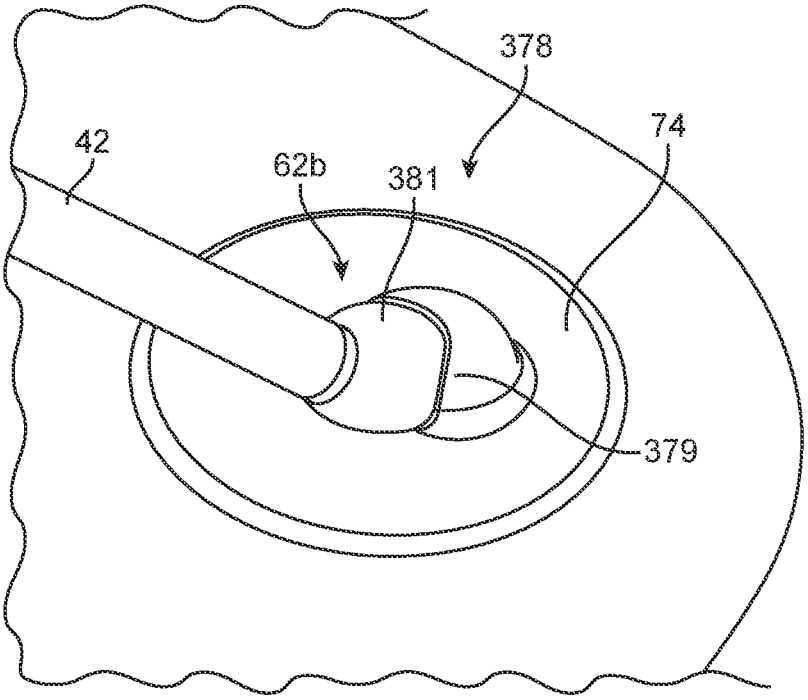
FIG. 9 is an enlarged perspective view illustrating a lower pole retainer according to another embodiment, which may be incorporated into the chairs of FIGS. 1, 7, and 23.

FIG. 9 illustrates a lower pole retainer 378 according to another embodiment, which may be incorporated into the chairs 10, 210 and any of the other chairs described herein. The bracket 74 includes a pocket 379 sized and shaped to receive a spherical element 381 disposed at the second end 62*b* of one of the cross support poles 42. The bracket 74 and pocket 379 are preferably made of a resilient material, allowing the spherical element 381 to be inserted into the pocket 379 in an insertion direction via a snap fit, and removed from the pocket 379 by applying sufficient force in a removal direction opposite the insertion direction.

Figure 10:
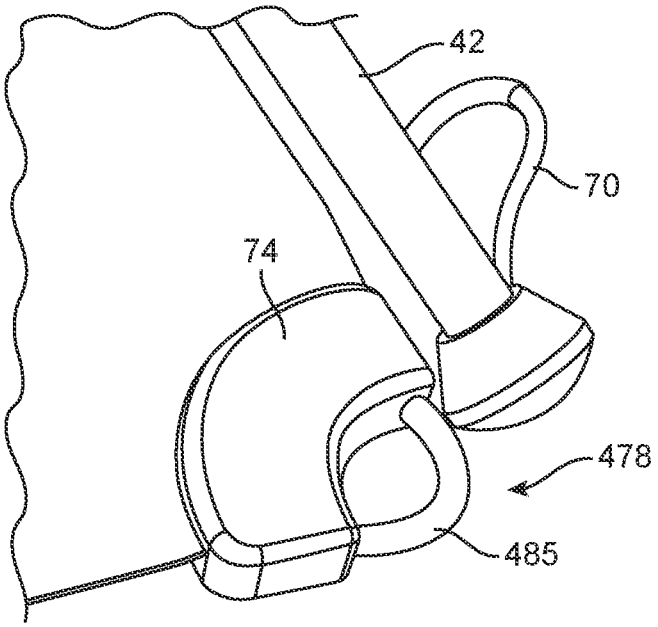
FIG. 10 is an enlarged perspective view illustrating a lower pole retainer according to another embodiment, which may be incorporated into the chairs of FIGS. 1, 7, and 23.
Figure 11:
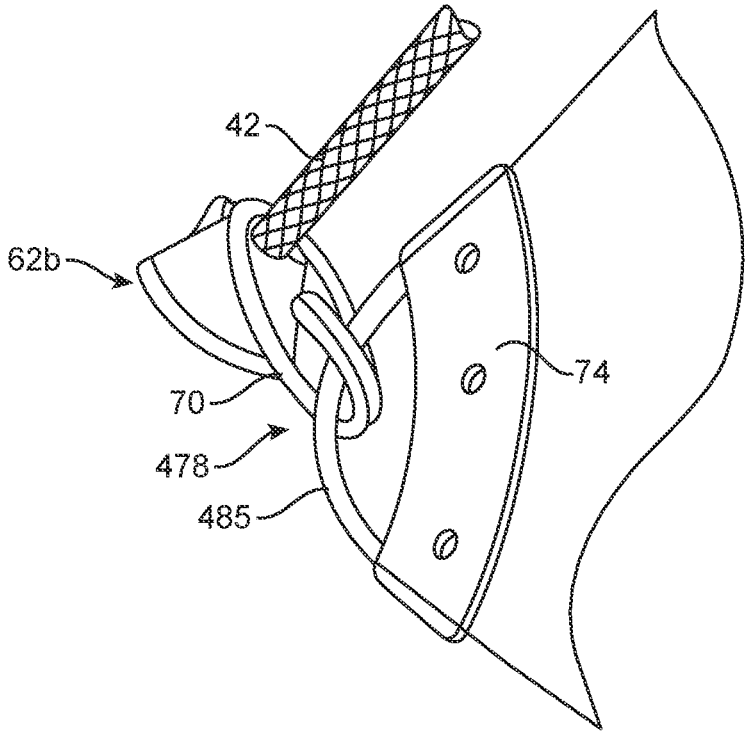
FIG. 11 is an enlarged perspective view illustrating the lower pole retainer of FIG. 10, with a tether coupling a pole to the lower pole retainer.

FIGS. 10-11 illustrate a lower pole retainer 478 according to another embodiment, which may be incorporated into the chairs 10, 210 and any of the other chairs described herein. Like the lower pole retainers 78, 278 described above, the lower pole retainer 478 is configured to receive the tether 70 on the second end 62*b* of one of the cross support poles 42. In particular, the lower pole retainer 478 includes a ring 485 extending from the bracket 74. The tether 70 may be inserted through the ring 485, and then the second end 62*b* of the cross support pole 42 is inserted through the tether 70, as shown in FIG. 11. This forms a strap knot (a.k.a. a girth or bale sling hitch) that couples the tether 70 (and thus, the cross support pole 42) to the ring 485. The ring 485, similar to cables 116, are preferably strong, lightweight, and semi-flexible, made out of a braided metal or polymer with high tensile strength, and may be, for example, stainless steel, Kevlar® fiber, or nylon braided cables. Additionally, the rings 485 may be coated with one or more protective polymer layers for improved durability and corrosion resistance.

Figure 12:
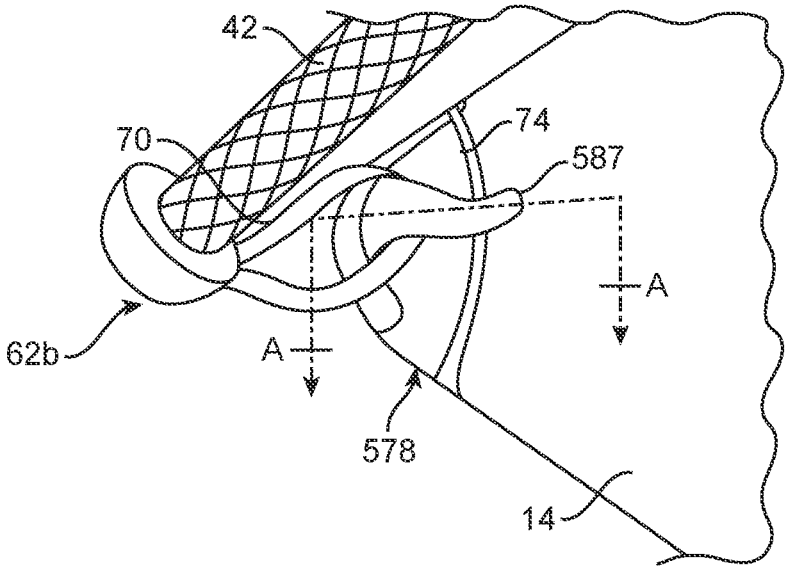
FIG. 12 is an enlarged perspective view illustrating a lower pole retainer according to another embodiment, which may be incorporated into the chairs of FIGS. 1, 7, and 23, and including a tether coupling a pole to the lower pole retainer.
Figure 13:
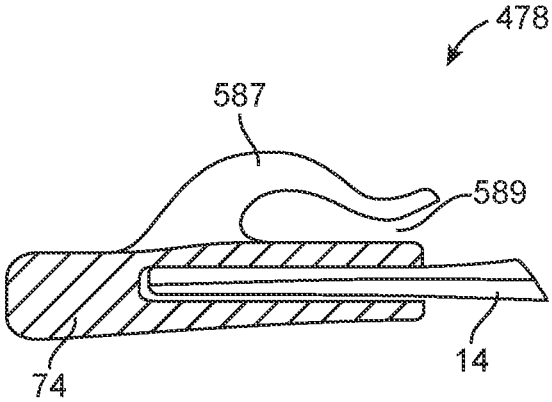
FIG. 13 is a cross-sectional view of the lower pole retainer of FIG. 12.

FIGS. 12-13 illustrate a lower pole retainer 578 according to another embodiment, which may be incorporated into the chairs 10, 210 and any of the other chairs described herein. Like the lower pole retainers 78, 278, 478 described above, the lower pole retainer 578 is configured to receive the tether 70 on the second end 62*b* of one of the cross support poles 42. In particular, the illustrated lower pole retainer 578 includes a hook 587 extending from the bracket 74. The tether 70 may be inserted through a passage 589 defined between the hook 587 and a top surface of the bracket 74, as shown in FIG. 13. The passage 589 is slightly narrower in width than the diameter of the tether 70, and the hook 587 is flexible, such that the hook 587 flexes away from the bracket 74 when inserting the tether 70 through the passage 589. When the tether 70 is inserted beyond the passage 589, the hook 587 restores itself toward the bracket 74, inhibiting inadvertent removal of the tether 70.

FIGS. 14-17 illustrate various ways in which the tether 70 may be attached to the cross support pole 42. For example, referring to FIG. 14, in some embodiments, the tether 70 may be inserted through a through-hole 75 in the foot 66, and the free end of the tether 70 then passed through a loop in the body of the tether 70, thereby creating a strap knot (a.k.a. a girth or bale sling hitch) to couple the tether 70 to the foot 66.

Figure 15:
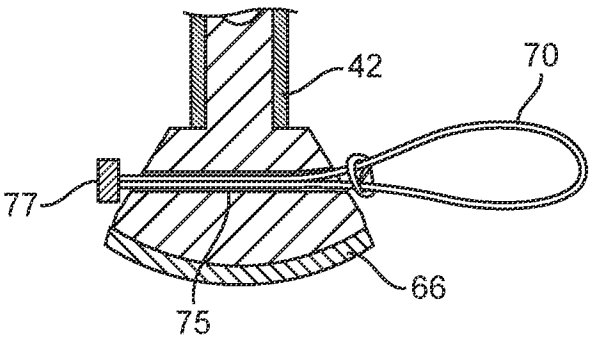
FIG. 15 is a cross-sectional view illustrating a tether attached to a foot of a pole according to a second embodiment, which may be incorporated into the chairs of FIGS. 1, 7, and 23.
Figure 14:
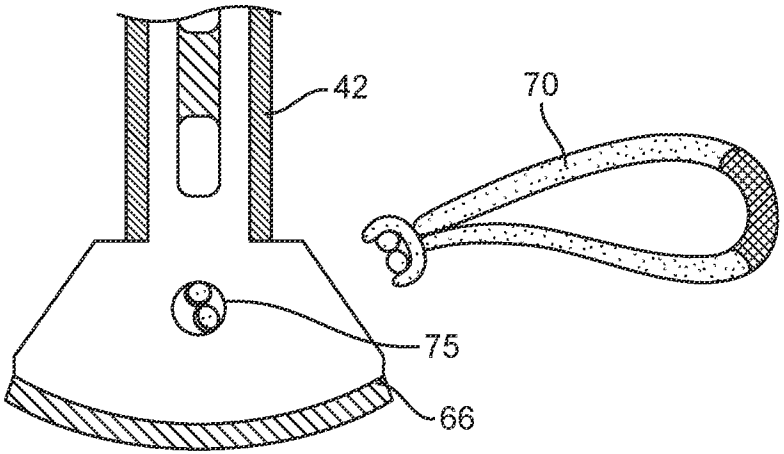
FIG. 14 is a cross-sectional view illustrating a tether attached to a foot of a pole according to a first embodiment, which may be incorporated into the chairs of FIGS. 1, 7, and 23.

With reference to FIG. 15, in another embodiment, the tether 70 may be inserted through a through-hole 75 in the foot 66 and then secured with a stopper 77 having a diameter greater than that of the through-hole 75.

Figure 16:
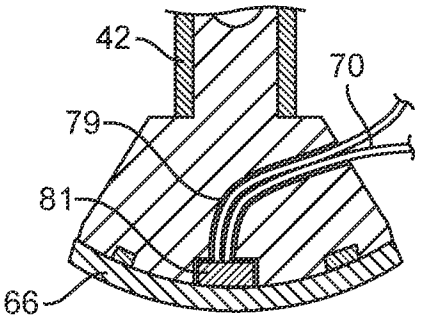
FIG. 16 is a cross-sectional view illustrating a tether attached to a foot of a pole according to a third embodiment, which may be incorporated into the chairs of FIGS. 1, 7, and 23.

With reference to FIG. 16, in another embodiment, the tether 70 may be inserted through a bore 79 in the foot 66 and into an adhesive reservoir 81. The adhesive within the reservoir 81 then cures to permanently couple the tether 70 to the foot 66.

Figure 17:
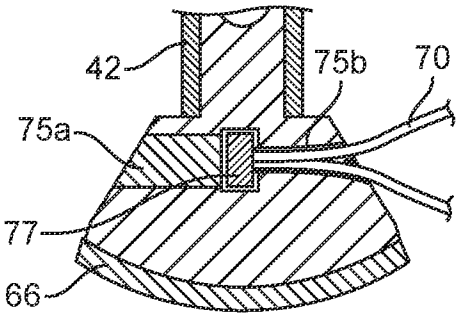
FIG. 17 is a cross-sectional view illustrating a tether attached to a foot of a pole according to a fourth embodiment, which may be incorporated into the chairs of FIGS. 1, 7, and 23.

With reference to FIG. 17, in another embodiment, the through-hole includes a first portion 75*a* having a first, larger diameter, and a second portion 75*b* having a second, smaller diameter. The tether 70 may be inserted through the first portion 75*a* and then the second portion 75*b*. The tether 70 includes a stop 77 with a diameter able to be received within the first portion 75*a* but greater than the diameter of the second portion 75*b*. The stop 77 may then be fixed within the first portion 75*a* of the through-hole (e.g., using an adhesive, a cap, or the like).

Figure 18:
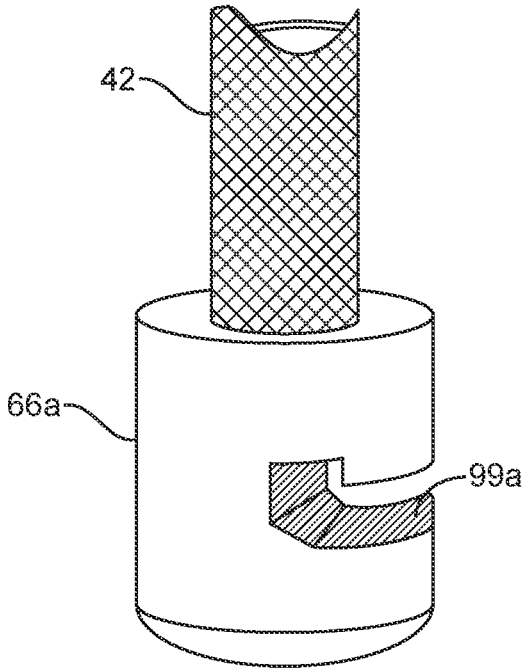
FIG. 18 is a perspective view illustrating a foot of a pole according to a first embodiment, which may be incorporated into the chairs of FIGS. 1, 7, and 23.
Figure 19:
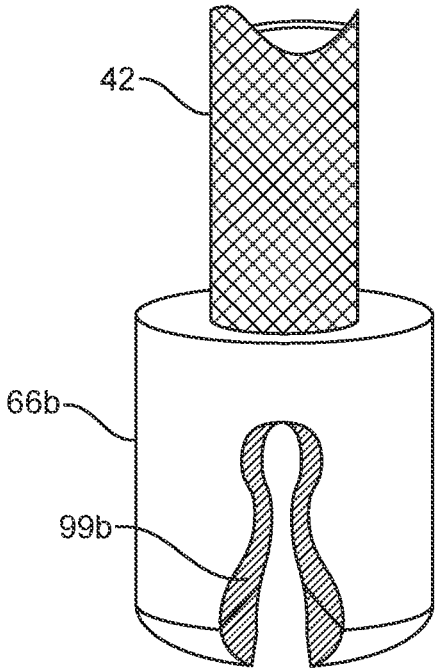
FIG. 19 is a perspective view illustrating a foot of a pole according to a second embodiment, which may be incorporated into the chairs of FIGS. 1, 7, and 23.

In some embodiments, the tether 70 may be omitted. Examples of such embodiments are illustrated in FIGS. 18-22. Referring to FIGS. 18 and 19, the cross support poles 42 may be provided with a foot 66*a*, 66*b* having a labyrinth channel 99*a*, 99*b* configured to receive a projection, ring, or the like (not shown) to couple each pole 42 to the base panel 14.

Figure 20:
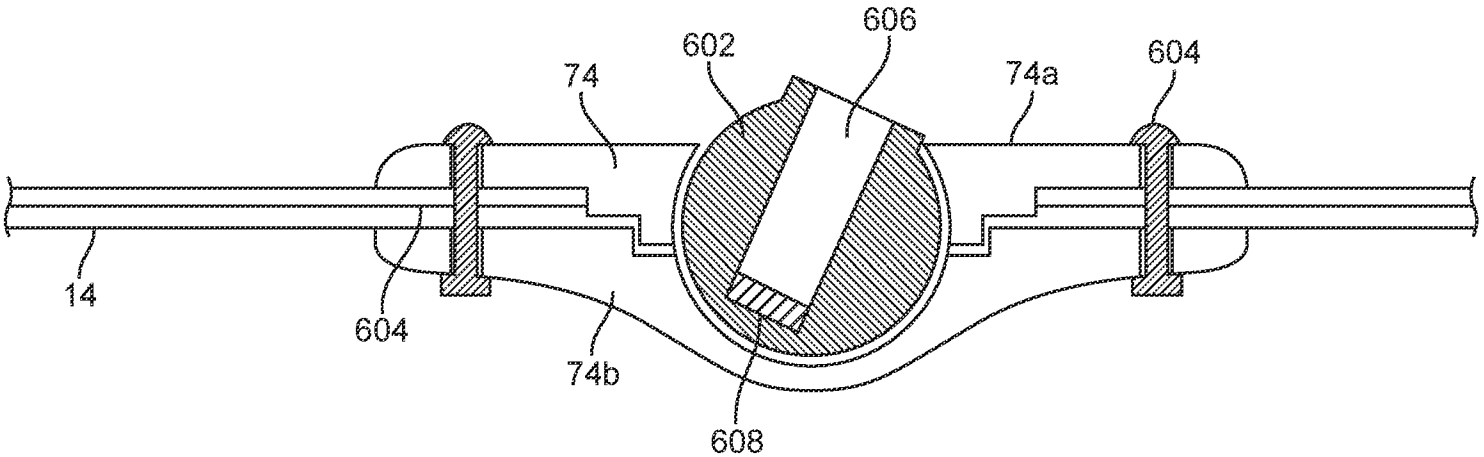
FIG. 20 is a cross-sectional view illustrating a lower pole retainer according to another embodiment, which may be incorporated into the chairs of FIGS. 1, 7, and 23.

With reference to FIG. 20, in another embodiment, each bracket 74 on the base panel 14 is provided with a spherical receiver 602 sandwiched between upper and lower sections 74*a*, 74*b* of the bracket 74. The upper and lower sections 74*a*, 74*b* may be coupled to the base panel 14 by mechanical fasteners 604, adhesive, or any other suitable means. The spherical receiver 602 includes a central bore 606 configured to receive the second end 62*b* of the cross support pole 42. In some embodiments, the central bore 606 may include a magnet 608 fixed at the bottom thereof, and the second end 62*b* of the cross support pole 42 may include a corresponding magnet or magnetic element attracted to the magnet 608 to retain the pole 42 within the bore 606. The spherical receiver 602 is able to rotate relative to the bracket 74 to allow the angle of the pole 42 to vary during use of the chair.

Figure 21:
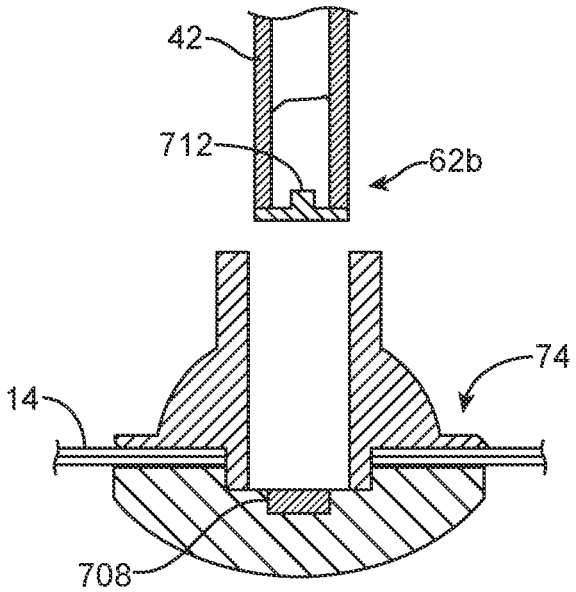
FIG. 21 is a cross-sectional view illustrating a lower pole retainer according to another embodiment, which may be incorporated into the chairs of FIGS. 1, 7, and 23.

Referring to FIG. 21, in another embodiment, each bracket 74 coupled to the base panel 14 includes a magnet 708, and each of the cross support poles 42 includes a magnet 712 located adjacent the second end 62*b*. The second end 62*b* of the cross support pole 42 is insertable into the bracket 74, and the magnets 708, 712 provide an attractive force to retain the second end 62*b* of the pole 42 within the bracket 74.

Figure 22:
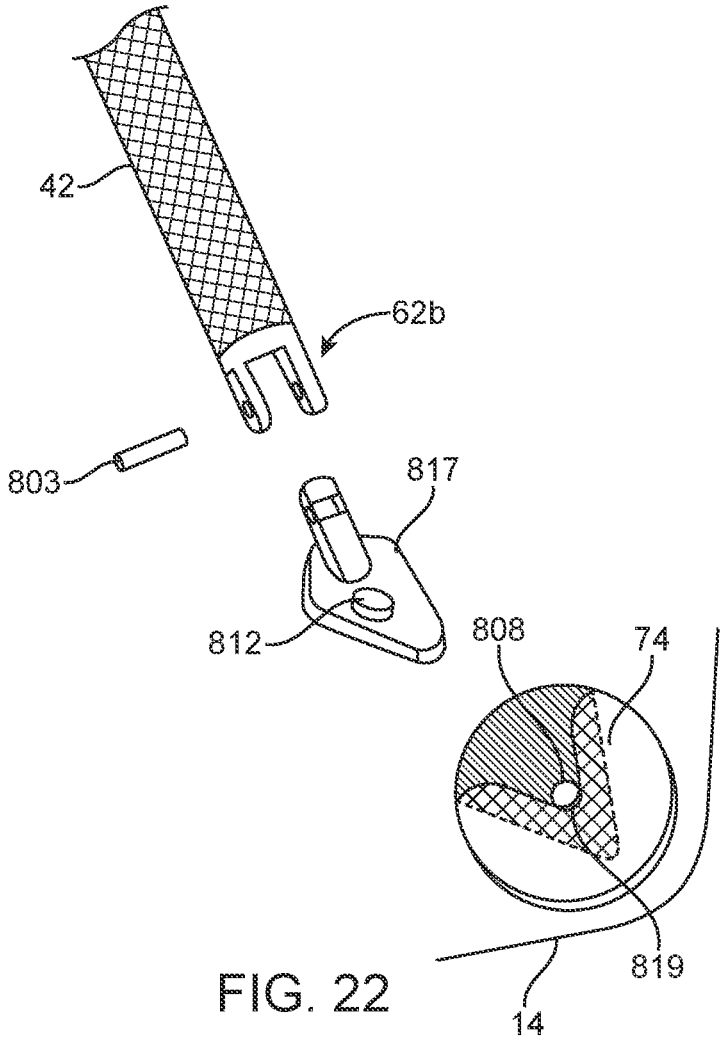
FIG. 22 is an exploded view illustrating a lower pole retainer according to another embodiment, which may be incorporated into the chairs of FIGS. 1, 7, and 23.

Referring to FIG. 22, in another embodiment, each bracket 74 on the base panel 14 includes a generally triangular pocket 819 and a magnet 808 located in or adjacent to the pocket 819. A foot 817 is pivotally coupled to the second end 62*b* of each cross support pole 42 (e.g., to a clevis at the second end 62*b*) by a pin 803. The foot 817 includes a magnet 812, which may be embedded in the foot 817 or attached to the foot 817 in any suitable manner. The foot 817 and pocket 819 are shaped such that the foot 817 is insertable into and self-aligning within the pocket 819. The magnets 808, 812 align when the foot 817 is fully inserted and provide an attractive force to retain the foot 817 within the pocket 819.

Figure 23:
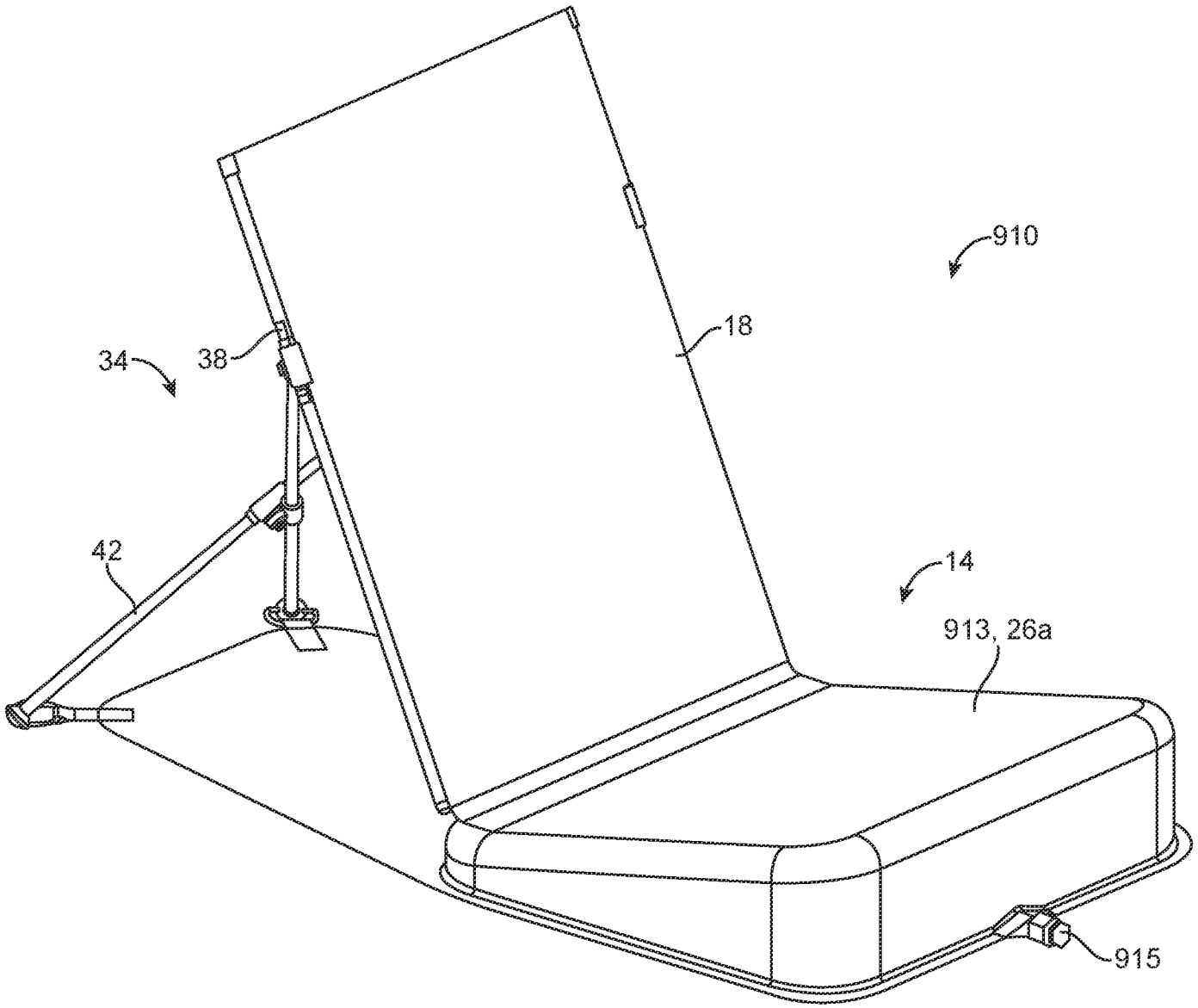
FIG. 23 is a perspective view of a chair according to another embodiment of the present disclosure.

FIG. 23 is a perspective view of a chair 910 according to another embodiment of the present disclosure. The chair 910 is similar to the chair 10 described above, and features and/or elements of the chair 910 may be incorporated into the chair 10, and vice versa. In addition, the following description focuses only on differences between the chair 910 and the chair 10, and features of the chair 910 corresponding with features of the chair 10 are given identical reference numbers.

The illustrated chair 910 includes a cushion 913 located within the seat section 26*a* of the base panel 14, to increase user comfort. The cushion 913 has a wedge shape in the illustrated embodiment, with a greater thickness at the front end of the base panel 14. The cushion 913 is preferably made of an open-cell foam material able to be filled with air. When the chair 910 is in its stored configuration, the open cell foam material of the cushion 913 is compressed, expelling air from the cells, and allowing the cushion 913 to be stored in a more compact size. When the chair 910 is put in the deployed position, the foam expands, drawing air into the cells through a valve 915. The valve 915 may be opened and closed to selectively allow and prevent air from flowing into and out of the cushion 913.

Figure 24:
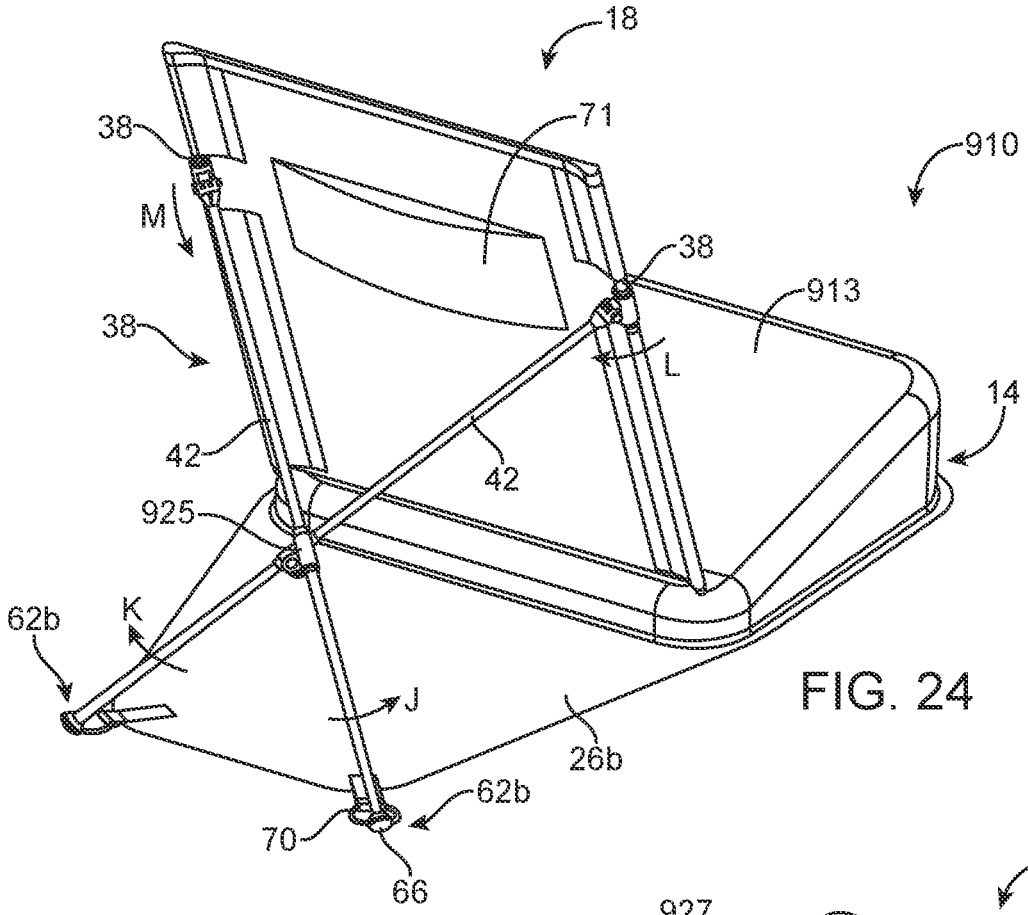
FIG. 24 is a rear perspective view of the chair of FIG. 23.

Referring to FIG. 24, the cross support poles 42 of the pole assembly 34 are joined together by a pole pivot connector 925. As shown in greater detail in FIGS. 25-26, the pole connector 925 includes two L-shaped pole link brackets 927 that securely couple the cross support poles 42 to one another via a pivot pin 931. The pole link brackets 927 are preferably made of a tough, UV-stable, and lightweight material, which may include metallics (e.g. aluminum) and/or polymers (e.g. ABS plastic), and may be axially secured to the pin 931 in any suitable manner (e.g., using C-clips, clevis pins, or the like). Each of the cross support poles 42 extends through or over a bore 933 in a respective one of the pole link brackets 927. The poles 42 may be fixed within the bores 933 by collars 935, which may be pressed on or adhered to the poles 42 at each end of the bore 933.

Figure 25:
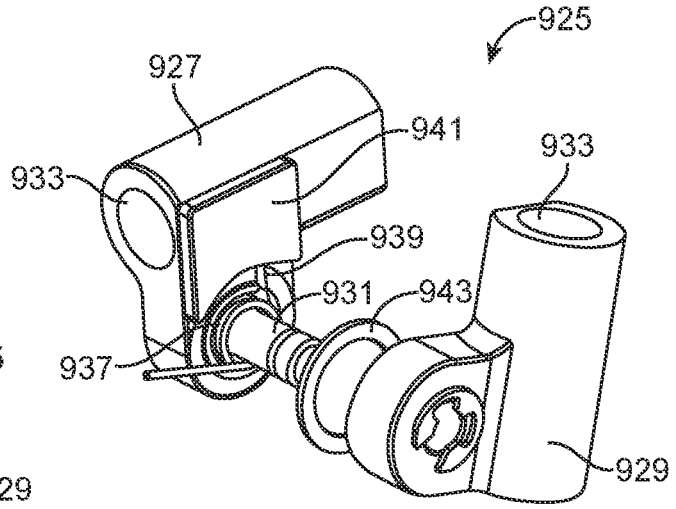
FIG. 25 is a partially-exploded perspective view illustrating a pole pivot connector of the chair of FIG. 23.
Figure 26:
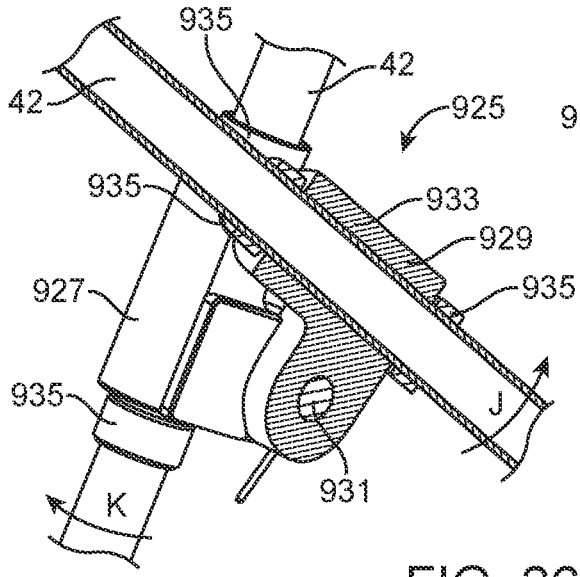
FIG. 26 is a cross-sectional view of the pole pivot connector of FIG. 25.

As shown in FIG. 25, the pole pivot connector 925 further includes a torsion spring 937 surrounding the pin 931. Free ends of the torsion spring 937 are received in respective grooves 939 of the pole link brackets 927. As described in greater detail below, the torsion spring 937 biases the pole link brackets 927, and thus, the attached cross support poles 42, toward the deployed position (i.e., in the direction of arrows J and K in FIG. 24). A stop 941 is positioned between the pole link brackets 927 to limit movement of the pole link brackets 927 to the deployed position. In the illustrated embodiment, a low-friction washer 943 (e.g., made of nylon, Delrin®, or another suitable low-friction material) surrounds the pin 931 and is disposed between the two pole link brackets 927 to promote smooth rotation of the pole link brackets 927.

Figure 27:
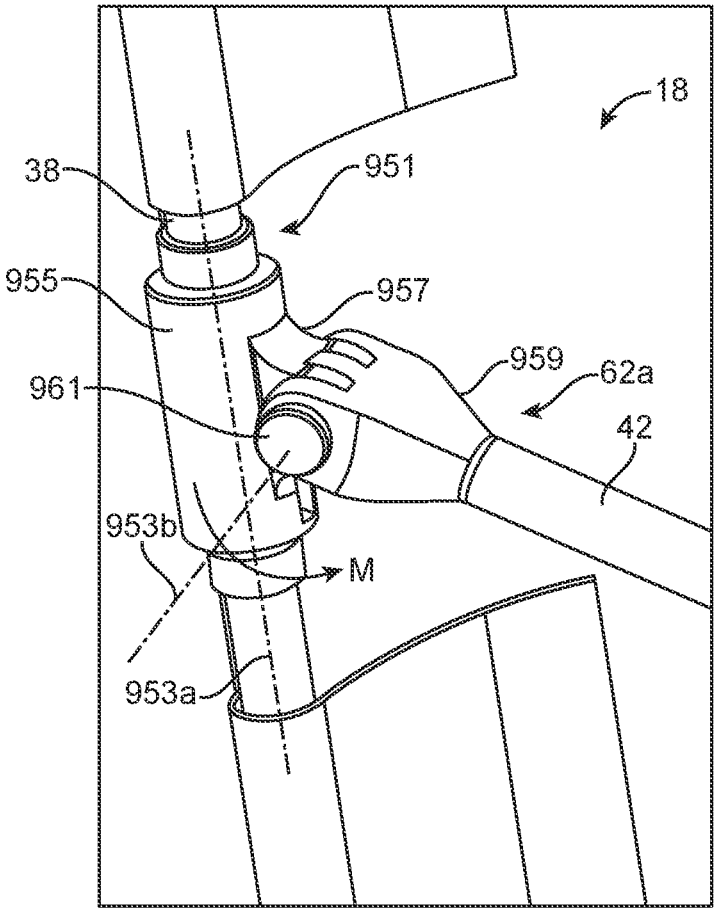
FIG. 27 is an enlarged perspective view illustrating an upper pole retainer of the chair of FIG. 23.

Referring to FIG. 27, the first end 62*a* of each cross support pole 42 is movably coupled to an associated one of the back support poles 38 by an upper pole retainer 951. The illustrated upper pole retainer 951 allows the cross support pole 42 to pivot relative to the back support pole 38 about two perpendicular axes 953*a*, 953*b*. More specifically, the upper pole retainer 951 includes a sleeve bearing 955 surrounding and axially fixed to the back support pole 38. A clevis 957 extends from the sleeve bearing 955, and a coupler 959 at the first end 62*a* of the cross support pole 42 interfaces with the clevis 957 to receive a pin 961 therethrough. The sleeve bearing 955 is rotatable about the first axis 953*a*, which is a longitudinal center axis of the back support pole 38. The coupler 959 is rotatable relative to the clevis 957 about the second axis 953*b*, which is a longitudinal center axis of the pin 961.

Figure 28:
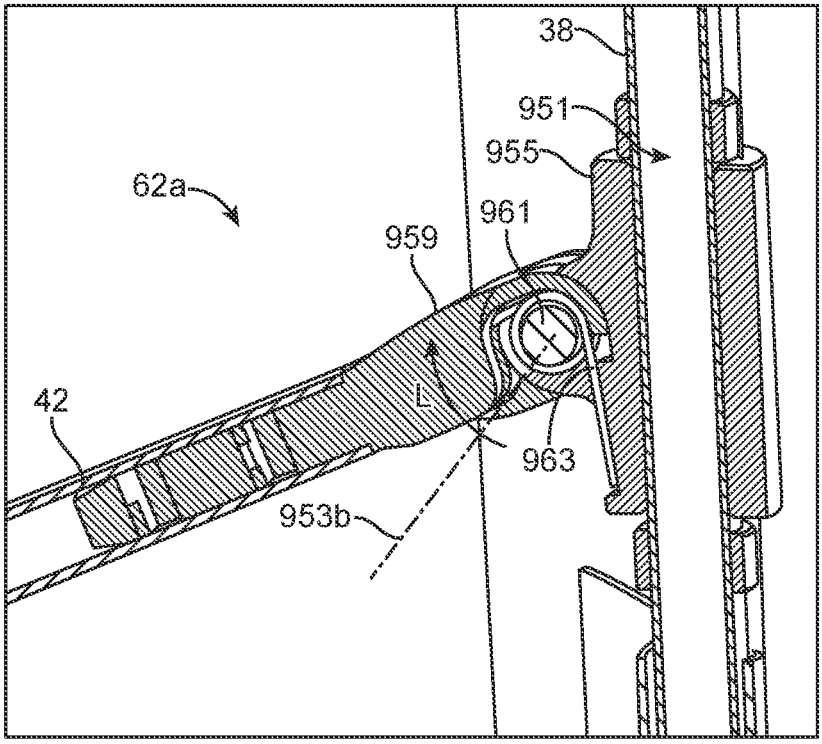
FIG. 28 is an enlarged cross-sectional view illustrating an upper pole retainer of the chair of FIG. 23.

With reference to FIG. 28, each of the upper pole retainers 951 includes a torsion spring 963 surrounding the pin 961. The torsion spring 963 acts on the coupler 959 and the clevis 957 to bias the connected cross support pole 42 from an orientation parallel to the back support pole 38 to a more perpendicular configuration (i.e., in the directions of arrows L and M illustrated in FIGS. 24, 27, and 28).

Referring again to FIG. 24, the second end 62*b* is a ground-engaging end configured to engage the ground (or another surface) when the chair 910 is positioned thereon in the deployed position. The second end 62*b* includes a foot 66 (e.g., made of plastic or rubber) and a tether 70, which in the illustrated embodiment is a metal ring, extends from the foot and is permanently connected to the cape section 26*b* via a sewn nylon webbing loop.

In use, to assemble the chair 910 into the deployed configuration (as shown in FIGS. 23-24), a user need only release the pole assembly 34 (e.g., by removing a retaining strap retaining the pole assembly 34 in the stored configuration (FIG. 29) against the biasing force of the torsion springs 937, 963; by removing the chair 910 from a bag constraining the pole assembly 34 in the stored configuration, or the like). The torsion springs 937, 963 then cause the upper pole retainers 951 and pole pivot connector 925 and thus, the cross support poles 42, to pivot in the directions of arrows J, K, L, and M in FIG. 24. The second ends 62*b* of the cross support poles 42 move outwardly to apply multi-axis tension to the cape 26*b*. Optionally, the user may then open the valve 915 to automatically inflate the cushion 913.

Figure 29:
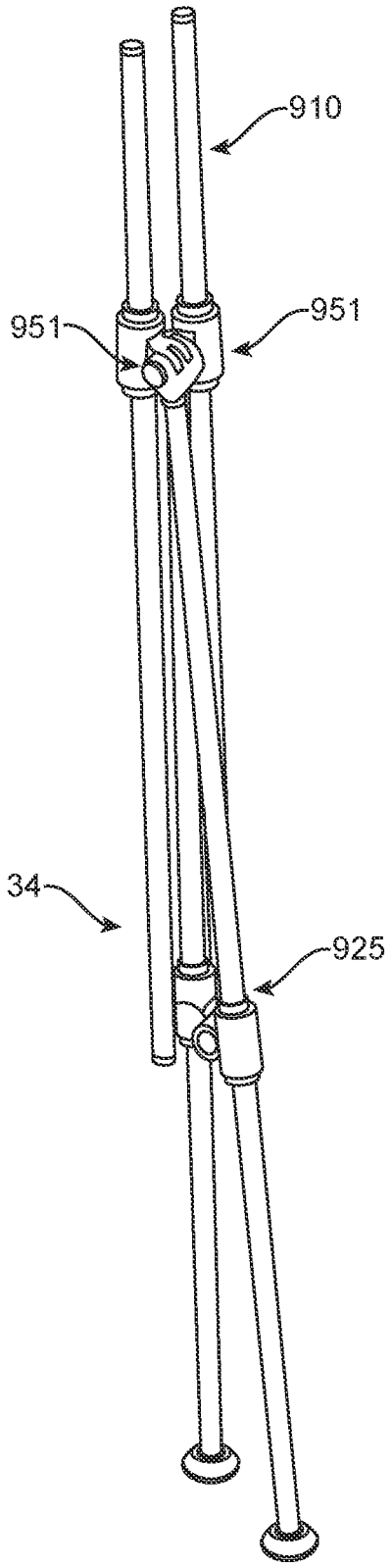
FIG. 29 is a perspective view illustrating the pole assembly of the chair of FIG. 23 in a stored configuration, with the fabric panels of the chair hidden for clarity.

When finished sitting on the chair 910, the user may disassemble the chair 910 by opening the valve 915 and deflating the cushion 913, and then grasping the pole assembly 34 to pivot the cross support poles 42 in the opposite direction and towards the back support poles 38, against the biasing force of the torsion springs 937, 963. The pole connector 925 and the upper pole retainers 951 allow the poles 38, 42 to pivot to a generally in-line, collapsed configuration as shown in FIG. 29, which defines the storage configuration of the chair 910. The base panel 14 and support panel 18 remain attached in place on the pole assembly 34 when the chair 910 is in the storage configuration, but are hidden in FIG. 29 for the sake of clarity. In some embodiments, the chair 910 may fit within a cylindrical container (e.g., storage bag, etc.) with a diameter of less than 3 inches in some embodiments, and less than 2.5 inches in other embodiments, allowing the chair 910 to be easily packed and transported.

Various features and aspects of the disclosure are set forth in the following claims.

What is claimed is:

1. A chair comprising:

a first fabric panel having a first end and a second end opposite the first end;

a second fabric panel coupled to the first panel between the first end and the second end such that the second fabric panel divides the first fabric panel into a seat section between the second fabric panel and the first end, the seat section configured to be sat upon by a user, and a rear section between the second fabric panel and the second end;

a first back support pole received within a first sleeve extending along a first side of the second fabric panel;

a second back support pole received within a second sleeve extending along a second side of the second fabric panel;

a first cross support pole having a first end coupled to the second back support pole and a second end coupled to the second end of the second fabric panel; and a second cross support pole having a first end coupled to the first back support pole and a second end coupled to the second end of the second fabric panel, such that the first cross support pole and the second cross support pole cross one another, wherein the chair has an overall weight less than 12 ounces.

2. The chair of claim 1, wherein the chair has an overall weight less than 10 ounces.

3. The chair of claim 1, further comprising a reinforcing strip coupled to the first fabric panel and the second fabric panel along an interface between the first fabric panel and the second fabric panel.

4. The chair of claim 1, wherein the first fabric panel defines a back support of the chair.

5. The chair of claim 1, wherein the first end of the first cross support pole is pivotally coupled to the second back support pole by a first pole connector, and wherein the first end of the second cross support pole is pivotally coupled to the first back support pole by a second pole connector.

6. The chair of claim 5, wherein the first pole connector includes a shank portion inserted into an end of the first cross support pole, and wherein the second pole connector includes a shank portion inserted into an end of the second cross support pole.

7. The chair of claim 1, further comprising a cushion located within the seat section.

8. The chair of claim 7, wherein the cushion includes an open-cell foam material configured to be filled with air to expand the cushion, and wherein the cushion is compressible by expelling the air from the open-cell foam material.

9. The chair of claim 1, further comprising a spine extending along the rear section.

10. The chair of claim 1, further comprising a first lower pole retainer disposed at a first corner of the rear section, and a second lower pole retainer disposed at a second corner of the rear section.

11. The chair of claim 10, wherein the second end of the first cross support pole is coupled to the first lower pole retainer by a first tether, and wherein the second end of the second cross support pole is coupled to the second lower pole retainer by a second tether.

12. The chair of claim 10, wherein the first and second cross support poles are removably coupled to the first and second lower pole retainers.

13. The chair of claim 1, wherein the first fabric panel and the second fabric panel are made of nylon.

14. The chair of claim 1, wherein the first and second back support poles and the first and second cross support poles are made of carbon fiber.

15. The chair of claim 1, wherein the first fabric panel includes a waterproof coating.

16. A chair comprising:

a first fabric panel having a first end and a second end opposite the first end;

a second fabric panel coupled to the first panel between the first end and the second end such that the second fabric panel divides the first fabric panel into a seat section between the second fabric panel and the first end, the seat section configured to be sat upon by a user, and a rear section between the second fabric panel and the second end;

a first back support pole received within a first sleeve extending along a first side of the second fabric panel, the first back support pole having first and second opposite ends;

a second back support pole received within a second sleeve extending along a second side of the second fabric panel, the second back support pole having first and second opposite ends;

a first cross support pole having a first end coupled to the second back support pole between the first and second ends of the second back support pole, and a second end coupled to the second end of the second fabric panel; and a second cross support pole having a first end coupled to the first back support pole between the first and second ends of the first back support pole, and a second end coupled to the second end of the second fabric panel, such that the first cross support pole and the second cross support pole cross one another.

17. The chair of claim 16, wherein the chair has an overall weight less than 12 ounces.

18. The chair of claim 17, wherein the first and second fabric panels are made of nylon, wherein the first and second back support poles are made of carbon fiber, and wherein the first and second cross support poles are made of carbon fiber.

19. The chair of claim 16, wherein the first and second cross support poles are pivotally coupled to the first and second back support poles.

20. The chair of claim 16, wherein the first and second cross support poles are coupled together by a cross pole connector located at a position where the first cross support pole and the second cross support pole cross one another, and wherein the cross pole connector inhibits the first and second cross support poles from separating from one another.

* * * * *